United States Patent [19]

Song

[11] Patent Number: 4,842,546

[45] Date of Patent: Jun. 27, 1989

[54] COVERED WIRE CONNECTING DEVICE FOR POWER SOURCE CONNECTING PLUG

[76] Inventor: Won J. Song, 295-9, Jangan 1-dong, Dongdaemun-ku, Seoul, Rep. of Korea

[21] Appl. No.: 185,782

[22] Filed: Apr. 25, 1988

[30] Foreign Application Priority Data

May 25, 1987 [KR] Rep. of Korea ..... 1987/8145

[51] Int. Cl.[4] ..... H01R 4/24

[52] U.S. Cl. ..... 439/409; 439/425

[58] Field of Search ..... 439/409, 417, 418, 425

[56] References Cited

U.S. PATENT DOCUMENTS 2,408,045 9/1946 Cottrell ..... 439/409

4,418,978 12/1983 Shamir ..... 439/409

*Primary Examiner*—Joseph H. McGlynn

*Attorney, Agent, or Firm*—Fleit, Jacobson, Cohn, Price, Holman & Stern

[57] ABSTRACT

A device for connecting a covered wire to a connecting terminal of a plug comprising a coupling portion of the inner end of each connecting terminal inserted in the lower plug body is formed a connecting needle pierceably into the covered portion of the covered wire, and a pressing pieces provided with the upper plug body for pressing the covered wire so that coupling and connecting between each covered wire and connecting terminal is made automatically by combining the upper and lower bodies.

1 Claim, 3 Drawing Sheets

FIG, 1
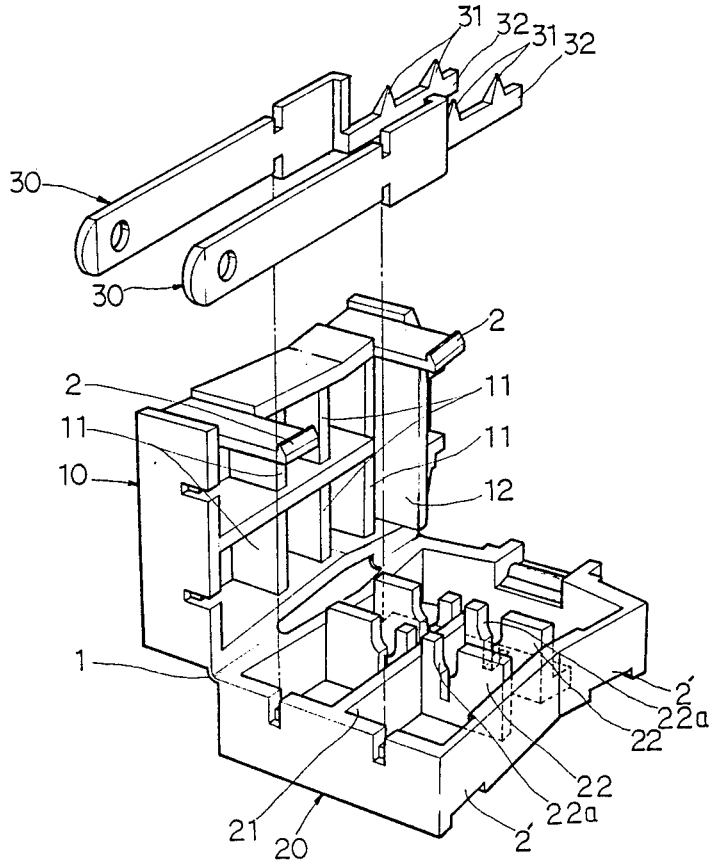

FIG,2
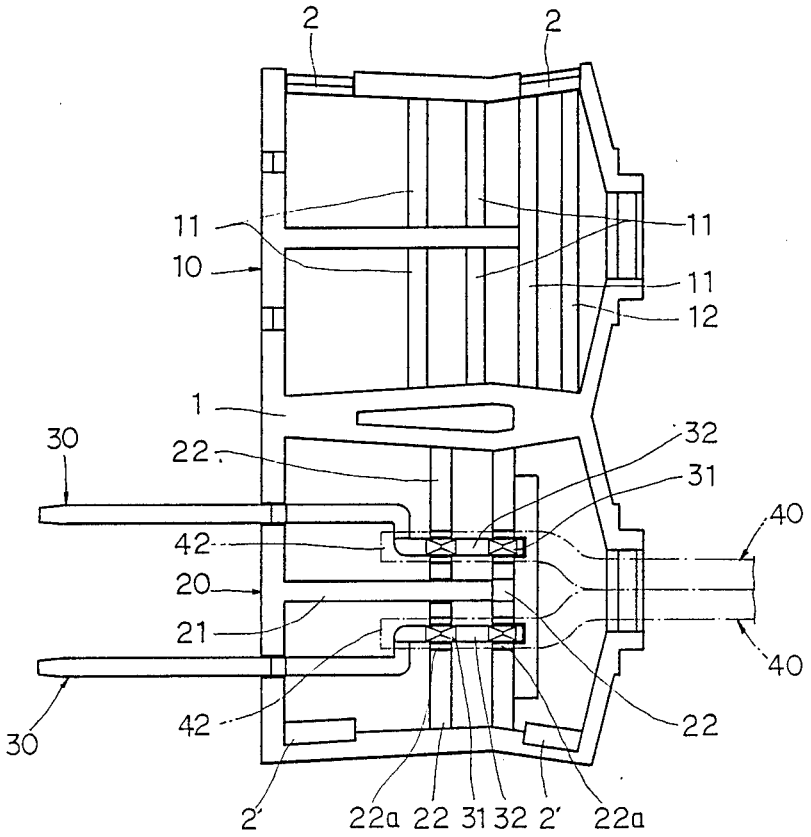

FIG,3
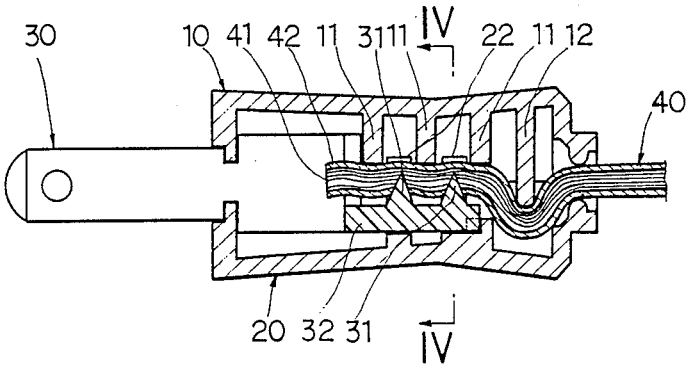
FIG,4
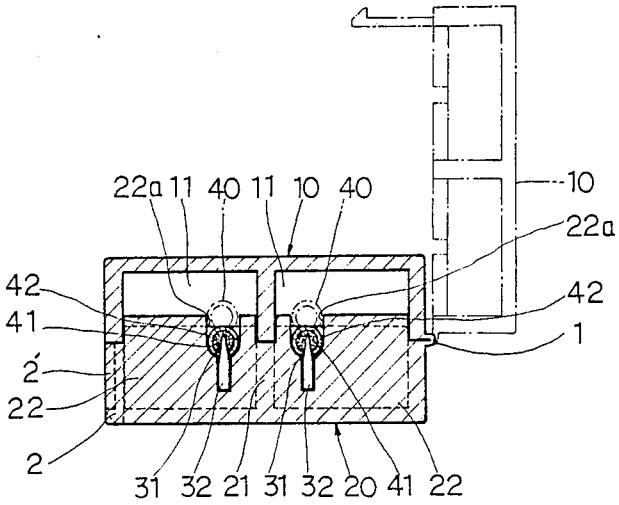

COVERED WIRE CONNECTING DEVICE FOR POWER SOURCE CONNECTING PLUG

BACKGROUND OF THE INVENTION

The present invention relates to a covered wire connecting device for a power source connecting plug, and particularly relates to a covered wire contactor for a power source connecting plug, which is adapted to connect a connecting terminal to a covered wire without stripping off the covered wire by forming a connecting piece in a needle-form at the inner end of the connecting terminal with which the covered wire is coupled and contacted, and by combining the upper and lower bodies of the plug.

For coupling, up to now, a core wire of the covered wire with the inner ends of both connecting terminals inserted between the upper and lower plug bodies, a method has been used to strip off the covered ends of each covered wire as long as a predetermined length, to wind the covered end round a fixing screw coupled with the connecting terminal, to tighten the screw, and to couple and connect thereby each connecting terminal to the core wire of the covered wire.

However, such conventional coupling and connecting work has disadvantages in that it requires a complicated and troublesome stripping-off and coupling work of covered wire due to use of special tools, and also has problems in that in a case where the fixing screw is not fully tightened, or the screw is loosened due to an external impact, the connection between each wire and connecting terminal is relaxed and separated easily, and thereby an unsatisfactory connection is made.

SUMMARY OF THE INVENTION

Accordingly, the object of the invention is to resolve the difficulties and problems posed by the covered wire connecting structure of such conventional plug.

It is another object of the invention to provide a covered wire connecting device of a power source connecting plug in which in a coupling portion of the inner end of each connecting terminal inserted in the lower plug body is formed a connecting needle pierceable directly into the covered portion of a covered wire, and the upper plug body is provided with a piece pressing the covered wire so that coupling and connecting between each covered wire and connecting terminal is made automatically by combining the upper and lower bodies, and the connecting state thereof is maintained reliably.

BRIEF DESCRIPTION OF THE DRAWINGS

Embodiments of the invention will now be described in more detail, by way of example, with reference to the accompanying drawings.

In the drawings,

FIG. 1 is a disassembled perspective view of a plug provided with the device according to the invention;

FIG. 2 is a developed plan view showing the constitution of the device according to the invention, FIG. 3 is a sectional view of a combined state showing a connection state of the covered wire in the device according to the invention, FIG. 4 is a sectional view taken on the line IV—IV in FIG. 3.

DETAILED DESCRIPTION OF THE INVENTION

Referring to FIGS. 1 to 3, a plug for connecting a power source, in which are inserted and fixed the inner ends of both connecting terminals 30 to be coupled with core wires 41 of covered wires 40 between the separable upper and lower bodies 10, 20 a pair of connecting pieces 32 in a predetermined length, at the upper end of which several connecting needles 31 are protruded, are formed in a bent form at the inner end of the said connecting terminals 30, and each of such connecting pieces 32 is fitted in the lower side of the inserting grooves 22*a* of supporting pieces 22 formed oppositely between both walls of the lower body 20 and the intermediate separate wall 21, and in the middle portion inside the upper body 10 coupled with the upper portion of the said lower body 20 so as to cover the upper portion, several pressing pieces are formed in a certain distance, and each of the pressing pieces 11 are formed in a certain distance, and each of the pressing pieces 11 is arranged so as to cross each supporting piece 22 of the said lower body 20. In the drawings, the reference numeral 1 represents a coupling piece mounted across one side wall of each upper and lower body 10, 20; 2, 2' represents a hooking member, that is, hooking projection and hooking piece formed oppositely on the other side wall; 12 represents an intermediate pressing piece for preventing the covered wire 40 from separating; and 42 represents the covered portion of the covered wire.

The operational effect of thus constructed device of the invention is as follows:

For coupling and fixing the core wires 41 of the covered wires 40 to each connecting terminal 30 according to the device of the invention, the upper and lower bodies 10, 20 are first developed as shown in FIGS. 1 and 2, and in a state in which the ends of covered wires 40 are inserted in the inserting grooves 22*a* provided on the upper side of each supporting piece 22 of the lower body 20 which the connecting pieces 32 of each connecting terminal 30 are inserted in and fixed to, as shown by a dotted line in FIG. 4, the developed upper body 10 is covered and thereby the upper and lower body 10, 20 are combined under pressing so that the hooking projection 2 and hooking piece 2' are caught. Each pressing piece 11, formed in the upper body 10 presses down strongly, under the pressing force applied at that time, the upper sides of covered portion of each covered wire 40 inserted in the inserting grooves 22*a* of the said supporting pieces 22 and thereby each covered wire 40 is pushed in the lower sides of the inserting grooves 22*a* and the connecting needles 31 of each connecting piece 32 protruded in the lower side pierces the covered portions 42 of each covered wire 40 and is fitted between the inner core wires 41 so that a coupling and connecting between each covered wire 40 and connecting terminal 30 is realized as shown in FIGS. 3 and 4.

Thus coupled and connected covered wires 40 are pressed and fixed by each pressing piece 11 and intermediate pressing piece 12 in a state inserted in the said connecting needles 31 so that the hooking condition with each connecting terminal 30 and the upper and lower body 10, 20 is maintained exactly and firmly.

The covered wire connecting device of the power source connecting plug according to the invention as described above is constructed, for coupling and connecting each connecting terminal to the covered wire, in such a manner that the connecting pieces with a connecting needles are integrated with the inner end of the connecting terminals so that each connecting piece is fitted in and fixed to the supporting pieces of the lower body, and a number pieces to press the covered wire inserted in the supporting pieces are formed on the upper body so that a coupling and connecting of each connecting terminal to the core wire of the covered wire is realized only by combining the upper and lower bodies. Accordingly, the device according to the invention has an effect that the work, such as stripping-off the covered wire, tightening the screw, etc., may be excluded, and thereby it is possible for anyone to couple and connect easily and simply the connecting terminals and covered wires, and further to maintain more exactly and firmly the coupling and connecting state.

What is claimed is:

1. In a covered wire connecting device for a power source connecting plug having upper and lower bodies in which is inserted a connecting terminal coupled with a core wire of a covered wire, the improvement comprising:

connecting pieces formed at the inner end of the connecting terminal and having several needles protruding therefrom, supporting pieces having an inserting groove mounted on the lower body of the plug and associated with the connecting pieces, and a plurality of pressing pieces for pressing each covered wire fitted in the inserting groove of the supporting pieces, each pressing piece being formed on the inner side of the upper body of the plug and being mounted relative to the supporting pieces so that each connecting needle of the connecting pieces pierces a covered portion of each covered wire.

* * * * *